US010460586B1

(12) United States Patent
Walma et al.

(10) Patent No.: US 10,460,586 B1
(45) Date of Patent: Oct. 29, 2019

(54) LIGHTING WITH AIR QUALITY AND HAZARD MONITORING

(71) Applicant: Cooper Technologies Company, Houston, TX (US)

(72) Inventors: Kenneth Dale Walma, Peachtree City, GA (US); Nam Chin Cho, Peachtree City, GA (US); Ryan Lamon Cunningham, Fayetteville, GA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/603,225

(22) Filed: May 23, 2017

Related U.S. Application Data

(60) Provisional application No. 62/340,969, filed on May 24, 2016, provisional application No. 62/353,489, filed on Jun. 22, 2016.

(51) Int. Cl.

| | |
|---|---|
| ***G08B 17/00*** | (2006.01) |
| ***G08B 21/14*** | (2006.01) |
| ***H05B 33/08*** | (2006.01) |
| ***H04R 1/02*** | (2006.01) |
| ***G08B 5/38*** | (2006.01) |
| ***G08B 7/06*** | (2006.01) |

(52) U.S. Cl.
CPC ..... *G08B 21/14* (2013.01); *G08B 5/38* (2013.01); *G08B 7/06* (2013.01); *H04R 1/028* (2013.01); *H05B 33/0854* (2013.01)

(58) Field of Classification Search
CPC . G08B 21/14; G08B 7/06; G08B 5/38; H05B 33/0854; H04R 1/028
USPC ..... 340/632
See application file for complete search history.

(56) References Cited

U.S. PATENT DOCUMENTS

| | | | | |
|---|---|---|---|---|
| 2004/0253918 | A1* | 12/2004 | Ezell | F24F 11/0017 454/239 |
| 2006/0097063 | A1* | 5/2006 | Zeevi | F24F 11/0086 236/49.3 |
| 2006/0154596 | A1* | 7/2006 | Meneely, Jr. | F24F 11/0001 454/256 |
| 2011/0185302 | A1* | 7/2011 | Kalapodas | G06F 3/0481 715/771 |
| 2015/0096351 | A1* | 4/2015 | Orsini | G01N 21/53 73/28.01 |
| 2015/0259078 | A1* | 9/2015 | Filipovic | H04W 88/08 244/114 R |
| 2016/0127875 | A1* | 5/2016 | Zampini, II | H04W 4/043 370/311 |

* cited by examiner

*Primary Examiner* — Tanmay K Shah
(74) *Attorney, Agent, or Firm* — King & Spalding LLP

(57) ABSTRACT

A sensing and lighting device includes a lighting fixture comprising a light emitting diode (LED) light source. The sensing and lighting device further includes a sensor to sense the air at the sensor, and a power source. The LED light source and the sensor are powered by the power source.

17 Claims, 14 Drawing Sheets

LIGHTING WITH AIR QUALITY AND HAZARD MONITORING

CROSS REFERENCE TO RELATED APPLICATIONS

The present application claims priority under 35 U.S.C. Section 119(e) to U.S. Provisional Patent Application No. 62/340,969, filed May 24, 2016, and titled "Lighting With Hazard Detection And Notification," and to Provisional Patent Application No. 62/353,489, filed Jun. 22, 2016, and titled "Lighting With Air Quality Monitoring," the entire contents of which are incorporated herein by reference.

TECHNICAL FIELD

The present disclosure relates generally to lighting solutions, and more particularly to lighting with air quality monitoring, hazard detection, and notification functionalities.

BACKGROUND

Indoor air quality is a significant factor in occupant's health, productivity, comfort, and overall satisfaction with a building structure. In a commercial space, indoor air quality can have significant economic implications for occupants and landlords. In some cases, indoor air pollutant levels may be significantly higher than outdoor air pollutant levels. In addition to pollutants that enter an indoor space from outside, contaminants such as volatile organic compounds may be released by cleaning materials, building materials, and even furniture. ASHRAE and other sustainability codes and standards specify specific metrics and standards around ventilation rates, moisture, contaminants/pollutants, temperature, and many other factors.

Air quality sensors may be used to monitor the air quality of an indoor space. Further, many safety hazards such as fire, carbon monoxide, natural gas, and earthquake can be detected by specialized sensors. The quality of data collected from indoor air quality sensors and the effectiveness of safety hazard sensors may be dependent on the number of distributed sensors.

While some sensors operate on battery power, other sensors may require electrical wiring to receive power from the mains power supply. In some cases, adding wiring to existing structures may be particularly challenging. Further, conflicting priorities may exist between preferred locations for sensors that detect air quality and safety hazards and preferred locations for providing notification of detected air quality and detected safety hazards, for example, to occupants of a building. Thus, a solution that allows effective distribution of indoor air quality sensors and safety hazard sensors and that provides flexibility in installing the sensors while enabling improved notification of air quality and safety hazards is desirable.

SUMMARY

The present disclosure relates generally to lighting solutions, and more particularly to lighting with air quality monitoring, hazard detection, and notification functionalities. In an example embodiment, a sensing and lighting device includes a lighting fixture comprising a light emitting diode (LED) light source. The sensing and lighting device further includes a sensor to sense the air at the sensor, and a power source. The LED light source and the sensor are powered by the power source.

In another example embodiment, a sensing and lighting device includes a lighting fixture comprising a light emitting diode (LED) light source. The sensing and lighting device further includes a sensor to sense the air at the sensor and a driver that provides power to the LED light source. The sensing and lighting device also includes a control device that controls the power provided by the driver to the LED light source based on whether a hazard condition is detected by the sensor.

In another example embodiment, a system of sensing and lighting devices includes a first sensing and lighting device, a second sensing and lighting device, and a wireless control device that wirelessly receives air quality information from the first sensing and lighting device and from the second sensing and lighting device. The first sensing and lighting device and the second sensing and lighting device each includes a lighting fixture comprising a light emitting diode (LED) light source. The first sensing and lighting device and the second sensing and lighting device each further includes a sensor to sense the air at the sensor and a power source, where the LED light source and the sensor are powered by the power source.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
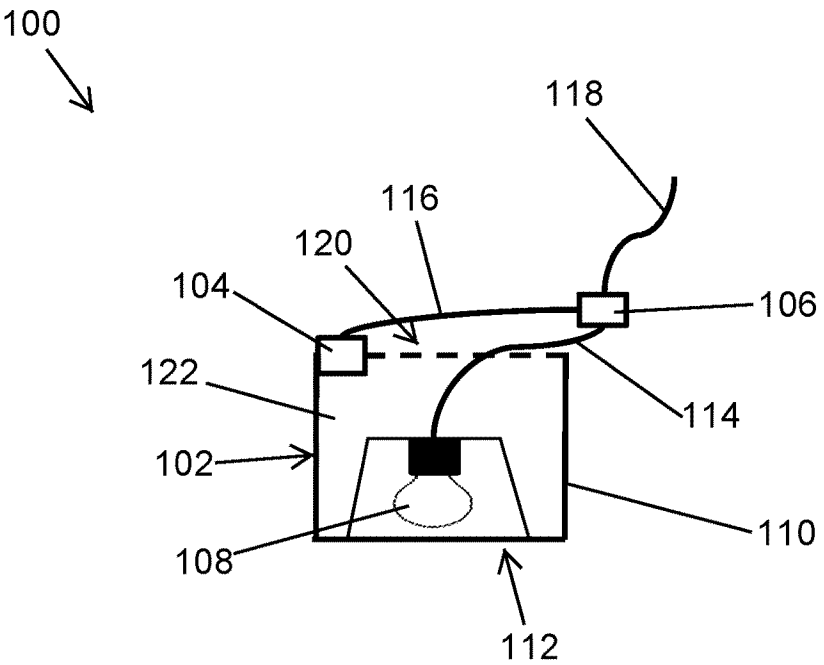
FIG. 1 illustrates a sensing and lighting device with an integrated sensor according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

Light fixtures are often widely distributed through a room or a building and may be continuously powered for long time durations. In many applications, light fixtures may also be integral parts of the air ventilation system of a building, where air return venting is contained within the light fixtures themselves. By leveraging the physical infrastructure of light fixtures, such as electrical wirings and support structures, sensor(s) that monitor air quality and/or that detect hazards may be integrated with light fixtures and operate in a seamless manner. For example, a sensor can be physically and electrically connected to a light fixture and leverage the communication network used by the light fixture. In some applications, a sensor that is integrated with lighting fixtures may communicate with a remote control device and/or with each other on a communication network that is separate from the communication network used by the lighting fixtures. The light sources of light fixtures may also be used to provide visual notifications upon detections of hazard conditions including low air quality conditions. Thus, lighting devices that have integrated sensor(s) may be used for illumination as well as for air quality monitoring, hazard detection, and notification of hazards including low air quality issues.

Turning now to the figures, particular example embodiments are described. FIG. 1 illustrates a sensing and lighting device 100 with an integrated sensor according to an example embodiment. Referring to FIG. 1, in some example embodiments, the sensing and lighting device 100 includes a lighting fixture 102 and a sensor 104. For example, the sensor 104 may be an air quality sensor, a hazard sensor, such as a fire sensor, a smoke sensor, a carbon monoxide sensor, an earth quake sensor, a natural gas sensor, and/or another type of sensor that can be integrated with the lighting fixture 102 as described herein. The sensing and lighting device 100 may also include a power source device 106 that provides power to the lighting fixture 102 and to the sensor 104. The lighting fixture 102 includes a housing 110 having a cavity 122. The lighting fixture 102 also includes a light source 108, such as an LED light source, that is powered by the power source device 106. For example, the light source 108 may be at least partially positioned in the housing 110.

In some example embodiments, the power source device 106 may be coupled to an AC power supply such as a mains supply via a connection 118 (e.g., electrical wires). For example, the power source device 106 may include one or more AC/DC converters to generate and provide DC power to the light source 108 and to the sensor 104. For example, the power source device 106 may provide DC power to the light source 108 and to the sensor 104 at different voltage levels.

In some example embodiments, the power source device 106 may include a driver, such as an LED driver, that provides power to the light source 108 via a connection 114 (e.g., one or more electrical wires). The power source device 106 may also include another power supply that provides DC power to the sensor 104 via a connection 116 (e.g., one or more electrical wires).

In some example embodiments, the housing 110 of the lighting fixture 100 may have a lower opening 112 and an upper opening 120. To illustrate, the lower opening 112 and the upper opening 120 may allow air to flow through the cavity 122 of the housing 110. The sensor 104 may be positioned such that air flowing through the cavity 122 of the housing 110 passes by the sensor 104. For example, the sensing and lighting device 100 is sized to fit in an air duct (e.g., an return air duct or plenum) of air conditioning system such as an HVAC (heating, ventilation, and air conditioning) system. The sensor 104 may monitor, for example, one or more of carbon monoxide level, carbon dioxide level, humidity, volatile organic compound(s), airborne particles above a particular size, temperature, natural gas, and/or other elements that allow the sensor 104 to monitor air quality and/or detect fire, smoke, etc.

In some example embodiments, the power source device 106 may include a wireless transmitter and receiver to wirelessly communicate with a remote control/monitoring device (e.g., a lighting control device), with other lighting fixtures, and/or with other sensing and lighting devices. For example, the sensor 104 may transmit sensor data such as air quality information (e.g., the presence or amount of an air pollutant) and hazard conditions (e.g., fire, smoke, low air quality such as when the amount of a pollutant exceeds a threshold, etc.) using the wireless transmitter that is in the power source device 106. Alternatively, the sensor 104 may transmit the sensor data over a wireless network that is different from of the lighting control wireless network used by the lighting fixture 102. The sensor 104 may alternatively or in addition transmit the sensor data over a wired connection directly or through the power source device 106. In some example embodiments, the sensing and lighting device 100 may not communicate wirelessly for lighting control purposes.

In some example embodiments, the light source 108 may flash its light to indicate detection of a hazard condition. For example, the device 100 may flash the light emitted by the light source 108 to indicate when a level of one or more of carbon monoxide, carbon dioxide, etc. exceeds a threshold level. As another example, the device 100 may flash the light emitted by the light source 108 to indicate detection of fire, smoke, earthquake, etc. Alternatively or in addition, the sensing and lighting device 100 may generate an audible notification of hazard conditions.

Although one sensor 104 is shown, in some alternative embodiments, the sensing and lighting device 100 may include two or more sensors of the same type or different types. For example, the sensing and lighting device 100 may include multiple sensors that sense different elements/conditions (e.g., carbon monoxide level, concentration of airborne particles, etc.) in the air that flow past the sensors. As another example, one or more sensors may monitor air quality and another one or more sensors may detect hazard conditions such as earthquakes. In some alternative embodiments, the sensor 104 may be positioned at a different location than shown in FIG. 1 without departing from the scope of this disclosure. For example, the sensor 104 may be positioned entirely within the cavity 122 of the housing 110, on a top cover of the housing 110, where the top cover has one or more openings such as the opening 120 to allow air to flow through the cavity 122 past the sensor 104.

Figure 2:
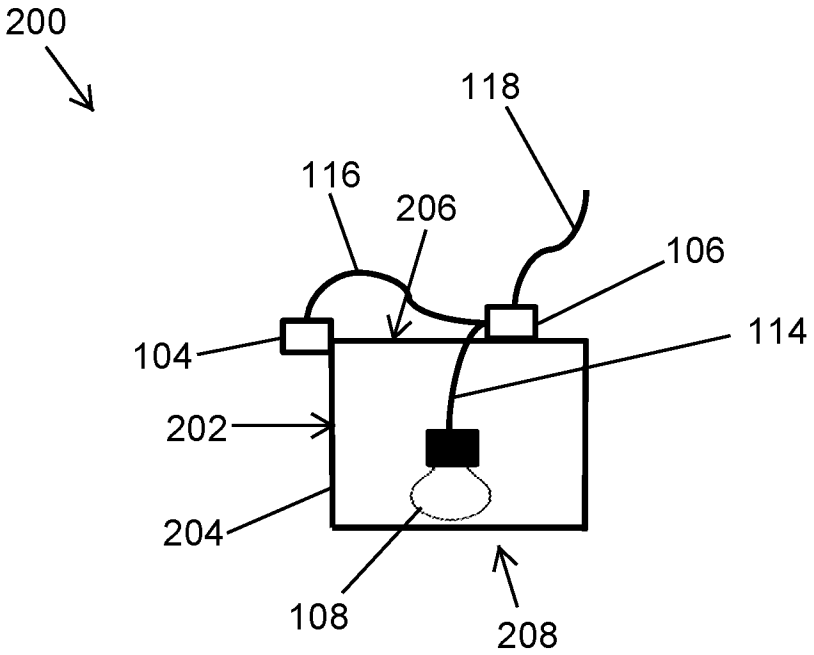
FIG. 2 illustrates a sensing and lighting device according to another example embodiment.

FIG. 2 illustrates a sensing and lighting device 200 according to another example embodiment. In some example embodiments, the sensing and lighting device 200 includes a lighting fixture 202 and the sensor 104 described above. The sensing and lighting device 200 may also include the power source device 106 that provides power to the lighting fixture 202 and to the sensor 104 in the same manner as described above with respect to the sensing and lighting device 100.

In some example embodiments, the lighting fixture 202 includes a housing 204 and the light source 108. For example, the power source device 106 may be positioned on a top cover 206 of the housing 204 and may provide power to the light source 108 as described above with respect to FIG. 1. To illustrate, the power source device 106 may provide power to the light source 108 via the connection 114 and may provide power to the sensor 104 via the connection 116.

In contrast to the sensor 104 of the device 100 of FIG. 1, in the sensing and lighting device 200, the sensor 104 is positioned on the outside of the housing 204. For example, the sensor 104 may monitor the air flowing past the sensor 104 on the outside of the housing 204 instead of the air flowing through the housing 204. To illustrate, the housing 204 may include the lower opening 208 but may be substantially covered by the top cover 206 that limits air flow through the housing 204. The lighting device 200 may be sized to fit in an HVAC air duct (e.g., an air return duct) of an HVAC system of a room or a building.

In some example embodiments, the light source 108 may flash its light to indicate detection of hazard conditions. For example, the light emitted by the light source 108 may flash to indicate levels of carbon monoxide, carbon dioxide, etc. that exceed threshold levels. As another example, the light emitted by the light source 108 may flash to indicate detection of fire, smoke, earthquake, etc. Alternatively or in addition, the sensing and lighting device 100 may generate an audible notification of low air quality conditions (e.g., detection of a particular pollutant or excessive amount of a pollutant) and other hazard conditions (e.g., fire, smoke, etc.).

In some alternative embodiments, the sensor 104 may be positioned at a different location than shown in FIG. 2 without departing from the scope of this disclosure. Although one sensor 104 is shown in FIG. 2, in some alternative embodiments, the sensing and lighting device 200 may include two or more sensors that monitor and/or detect different elements/conditions such as fire, smoke, various airborne particles, etc.

Figure 3:
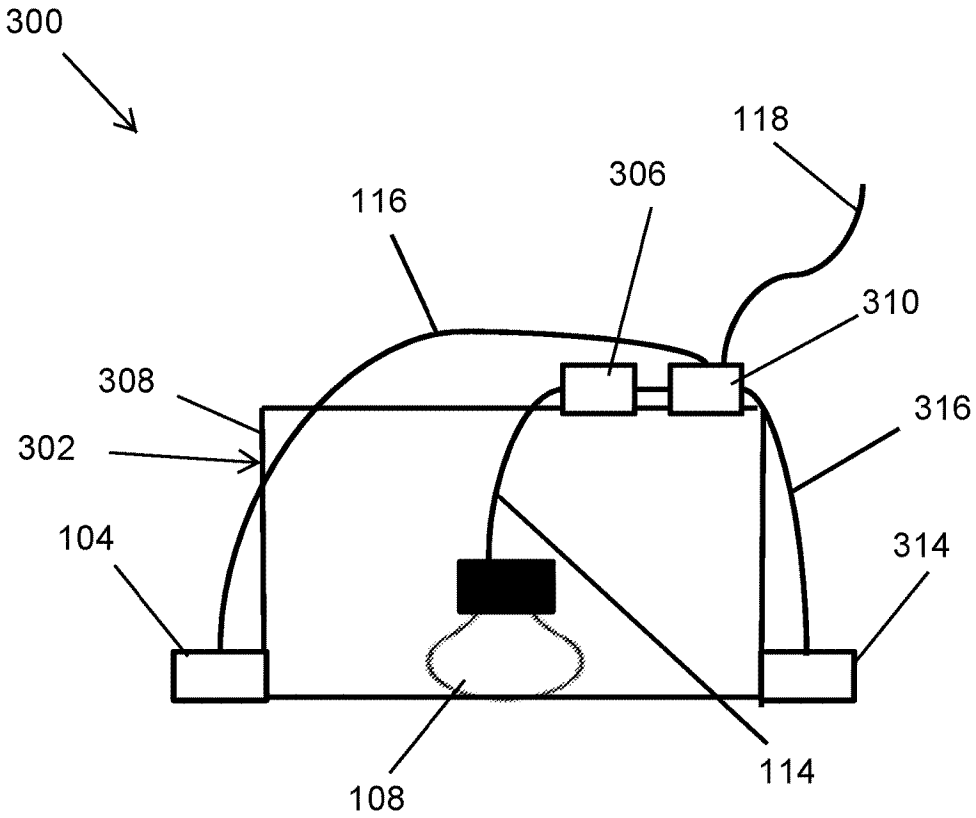
FIG. 3 illustrates a sensing and lighting device according to another example embodiment.

FIG. 3 illustrates a sensing and lighting device 300 according to another example embodiment. In some example embodiments, the sensing and lighting device 300 includes a lighting fixture 302 that includes the light source 108, a driver 306, a control device 310, and the sensor 104. The sensing and lighting device 100 may also include a siren 314. The light source 108 of the lighting fixture 302 may be an LED light source, and the driver 306 may be an LED driver (e.g., a 0-10 v dimmable LED driver). The driver 306 may be coupled to the light source 108 to provide power to the light source 108. For example, the driver 306 may generate and provide DC power to the light source 108 based on an input AC power from the controller device 410 as described below. The light source 108 may be located inside a housing 308 of the lighting fixture 302, and the driver 306 may be outside the housing 308. For example, the driver 306 and the control device 310 may be included in the power source device 106 described with respect to FIGS. 1 and 2. Alternatively, the driver 306 may be integrated with the light source 108 or may otherwise be located inside the housing 308.

In some example embodiments, the control device 310 is connected to the sensor 104 via the electrical connection 116. As described above, the sensor 104 may be one of different types of sensors such as a fire sensor, a smoke sensor, a carbon monoxide sensor, an earth quake sensor, a natural gas sensor, and/or another sensor that may be integrated with the lighting fixture 302. To illustrate, the sensor 104 may monitor, for example, one or more of carbon monoxide level, carbon dioxide level, humidity, volatile organic compound(s), airborne particles above a particular size, temperature, natural gas, and/or other elements that allow the sensor 104 to monitor air quality and/or detect fire, smoke, etc.

In some example embodiments, the control device 310 is also coupled to the driver 306 via an electrical connection such as electrical wires/traces and/or connectors. For example, the control device 310 may provide dim control and/or other lighting control signal(s) to the driver 306. To illustrate, the driver 306 may change the dim level of the light emitted by the light source 108 based on the dim control signal provided by the control device 310.

In some example embodiments, AC power may also be provided to the driver 306 from the control device 310 via an electrical connection. To illustrate, AC power may be provided to the control device 310 via the electrical connection 118, and the control device 310 may provide a switched AC power to the driver 306. For example, the control device 310 may include a relay that provides the switched AC power to the driver 306. The control device 310 may turn on/off the switched AC power provided to the driver 306 by switching on/off the relay. In some alternative embodiments, the line AC power that is not a switched-power may be provided to the driver 306 through the control device 310 or outside the control device 310. In some alternative embodiments, DC power instead of AC power may be provided to the control device 310 via the connection 118. In some example embodiments, the connection 118 may be an Ethernet cable (e.g., CAT 5e) that is used to provide power as well as for wired communication.

In some example embodiments, the sensor 104 may receive power from the driver 306. Alternatively, in some example embodiments, the sensor 104 may receive power from the control device 310. For example, the control device 306 may include a power supply (e.g., a battery, an AC/DC converter, etc.) that provides the appropriate power level to the sensor 104 via the electrical connection 116.

In some example embodiments, the control device 310 may receive one or more sensor signals from the sensor 104 that provide, for example, air quality information and hazard condition that have been detected by the sensor 104. For example, the sensor 104 may provide the information to the control device 310 via the connection 116, which may include multiple electrical wires. When the sensor 104 indicates a detection of a hazard condition to the control device 310, the control device 310 may cause the light emitted by the light source 108 to flash to provide a visual notification of the detection of the hazard condition. For example, the control device 310 may repeatedly change dim levels indicated by the dim control signal provided to the driver 306 between relatively high and relatively low intensity levels to cause the light emitted by the light source 108 to flash.

In some alternative embodiments, instead of using the dim control signal, the control device 310 may continually turn on and off the switched AC power provided to driver 306 by switching the relay of the control device 310 on/off. The turning on and off of the switched AC power results in the driver 306 turning on/off the power that the driver 306 provides to the light source 108, resulting in the flashing of the light emitted by the light source 108.

In some example embodiments, the siren 314 may generate an audible notification of one or more conditions including detected hazard conditions such as fire, smoke, low air quality, etc. For example, the siren 314 may be coupled to the control device 310 such that the control device 310 turns on the siren 314 to provide the audible notification upon detection of a hazard condition by the sensor 104 and/or to provide other notifications, for example, related to low air quality based on air quality monitoring by the sensor 104. The control device 310 may turn on the siren 314 by switching the power provided to the siren 314 over the electrical connection 316 (e.g., one or more electrical wires) or by providing an electrical signal that turns on to the siren 314 over the electrical connection 316.

In some example embodiments, the light source 108 may flash its light at a particular rate (e.g., flashing) to indicate a path, for example, to an exit door. For example, multiple lighting devices 300 that are disposed along a path that leads to an exit door may flash at a faster rate than other lighting devices 100 that are not along the path to the exit door. In some example embodiments, the path may be from an entrance to a possible cause of a hazard condition detected by the sensing and lighting device 300. For example, the particular sensing and lighting device 300 that detects a hazard condition may indicate (e.g., via wireless communication) the detection of a hazard to other instances of the lighting devices 300 either directly or via a centralized controller.

Some instances of the lighting devices 300 that are in the path from an entrance to the particular sensing and lighting device 300 that detected the hazard may flash their lights at a rate that is different from other lighting devices 300 that are not in the path. For example, location information of multiple lighting devices 300 may be stored in each individual sensing and lighting device 300 or in a central controller, for example, during system provisioning, and the location information may be used to identify the lighting devices 300 that are in a path to/from an exit/entrance. In some alternative embodiments, the sensing and lighting device 300 may include one or more indicator light sources (e.g., an LED light source that emits a particular color (e.g., red) light), where the indicator light sources are turned on if the sensing and lighting device 300 is in a path, for example, to/from an exit/entrance or to the particular sensing and lighting device 300 that detected the hazard condition.

Although one sensor is shown in FIG. 3, in some alternative embodiments, the sensing and lighting device 300 may include more sensors without departing from the scope of this disclosure. In some alternative embodiments, the components of the sensing and lighting device 100 including the sensor 104, the driver 306, the control device 310, and the siren 314 may be located differently than shown without departing from the scope of this disclosure. In some alternative embodiments, some of the components (e.g., the driver 306 and the control device 310) may be integrated into a single device such as the power source device 106 shown in FIGS. 1 and 2. In some alternative embodiments, another type of sound generation device may be used instead of or in addition to the siren 314 without departing from the scope of this disclosure. In some alternative embodiments, the sensor 104 that is shown on the outside of the housing 308 may be positioned inside the housing 308, for example, in a similar manner as shown in FIG. 1. In some alternative embodiments, the housing 308 may include one or more upper openings to allow air flow through the housing 308.

Figure 4A:
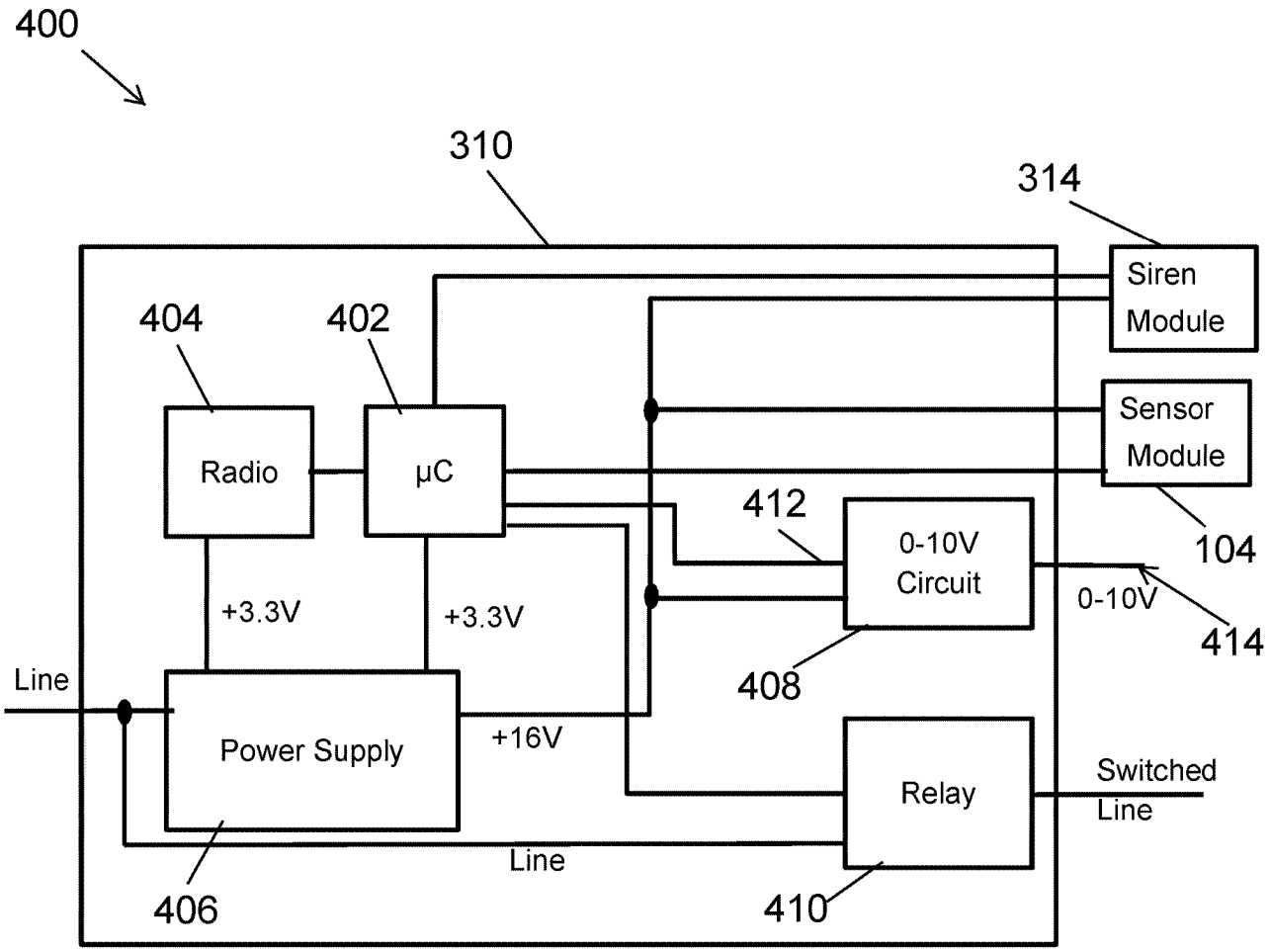
FIG. 4A illustrates the sensing and lighting device of FIG. 3 including the control device according to another example embodiment.

FIG. 4A illustrates the sensing and lighting device 300 of FIG. 3 including the control device 310 according to another example embodiment. Referring to FIGS. 3 and 4A, the control device 310 includes a controller 402 such as a microcontroller. The control device 310 may also include a wireless transceiver 404, a power supply 406, a 0-10 v dim control circuit 408, and relay 410. The controller 402 is in electrical communication with the transceiver 404, the 0-10 v circuit 408, and the relay 410. The controller 402 is also in electrical communication with the sensor 104 and the optional siren 314. For example, the controller 402 may be an integrated circuit controller such as PIC16F690. In some alternative embodiments, the controller 402 may be implemented using multiple circuits and components using an FPGA, an ASIC, or a combination thereof. The controller 402 may also include one or more memory devices for storing code that may be executed by the controller 402 and for storing data.

In some example embodiments, the power supply 406 may be coupled to a mains power via an input power line (Line), and may generate DC power provided to the controller 402, the transceiver 404, the 0-10 v circuit 408, the sensor 104, and the siren 314. As a non-limiting example, the power supply 406 may provide approximately 3.3V to the controller 402 and to the transceiver 404, and approximately 16V to the 0-10 v circuit 408, the sensor 104, and the siren 314. In some alternative embodiments, the power supply 406 may provide other voltage levels to the controller 402, the transceiver 404, the 0-10 v circuit 408, the sensor 104, and the siren 314 without departing from the scope of this disclosure. Alternatively, the sensor 104 may be powered by the driver 306 instead of by the power supply 406 without departing from the scope of this disclosure. In some alternative embodiments, DC power instead of AC power may be provided to the power supply 406, and the power supply 406 may generate different DC power outputs, for example, using DC/DC converter circuits.

In some example embodiments, the transceiver 404 may wirelessly receive lighting control commands and pass the commands to the controller 402 for processing. For example, based on the received commands, the controller 402 can switch on/off the relay 410, which is coupled to the AC power source by the connection 118 via the input power line (Line), to turn on/off the switched AC power signal provided by the relay 410 on an output power line (Switched Line). For example, the Switched Line may be coupled to the driver 306 shown in FIG. 3, and the switched AC power signal from the relay 410 may be provided to the driver 306 via the Switched Line.

In some example embodiments, based on commands wirelessly received by the transceiver 404, the controller 402 may also control the 0-10 v circuit 408 to change the dim control signal provided by the 0-10 v circuit 408 via an output 0-10 v port 414. For example, the controller 402 may provide a pulse-width-modulation (PWM) signal or another output signal to the 0-10 v circuit 408 via a connection 412 (e.g., one or more electrical wires or traces), and the 0-10 v circuit 408 may generate the dim control output signal that is provided on the 0-10 v output port 414, for example, to the driver 306.

Figure 4B:
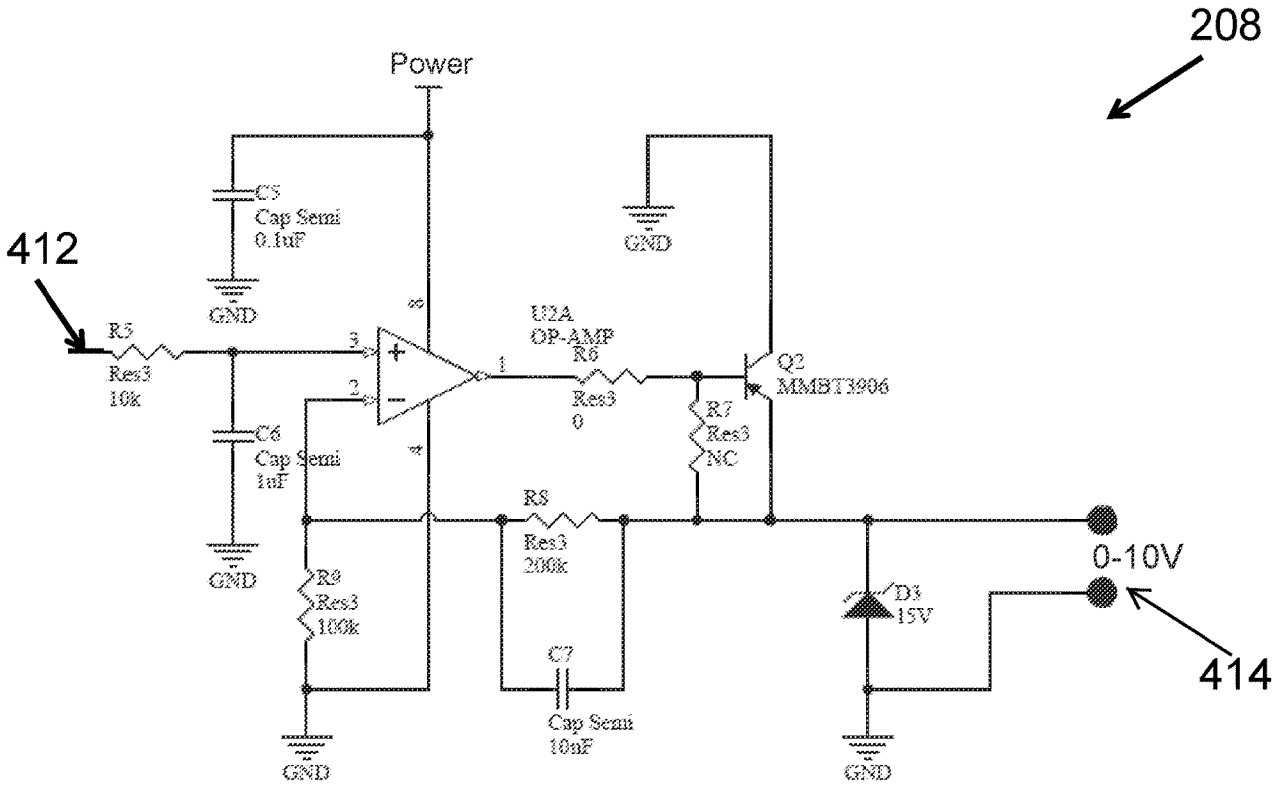
FIG. 4B illustrates an example circuit schematic of the 0-10 v circuit of the control device shown in FIG. 4A.

FIG. 4B illustrates an example circuit schematic of the 0-10 v circuit 408 of the control device 310 shown in FIG. 4A. Referring to FIGS. 3, 4A, and 4B, in some example embodiments, the controller 402 may provide an output control signal to the 0-10 v circuit 408 via the connection 412, and the 0-10 v circuit 408 may generate the corresponding dim control output signal on the output 0-10 v port 414 to control the amount of power that the driver 306 provides to the light source 108. Although particular parameter values are shown in FIG. 4B, in some alternative embodiments, other parameter values may be used without departing from the scope of this disclosure. Further, the 0-10 v circuit 408 may include other components and circuitry than shown in FIG. 4B without departing from the scope of this disclosure.

In some example embodiments, the transceiver 404 may wirelessly transmit lighting-related information, such as lighting status information. For example, the controller 402 may receive status and other lighting related information from the driver 306 and provide the information (as received and/or processed) to the transceiver 404 for wireless transmission.

In some example embodiments, the transceiver 404 may wirelessly transmit sensor-related information in addition or instead of lighting-related information. For example, the controller 402 may receive sensor-related information (e.g., air quality information, hazard condition information, etc.) from the sensor 104 and provide the information (as received and/or processed) to the transceiver 404 for wireless transmission. For example, the transceiver 404 may transmit the sensor-related information to a remote monitoring/control device such as to mobile wireless device that may have a resident software application, for example, to process, display, transmit the information received from the transceiver 404. The transceiver 404 may also wirelessly receive information (e.g., instructions) intended for the sensor 104.

In some example embodiments, the sensor 104 may provide one or more sensor signals to the controller 402 to indicate whether the sensor 104 is detecting/has detected a hazard condition, such as a gas leak, a low air quality condition, or other relevant conditions that may require providing a notification. To illustrate, when a sensor signal from the sensor 104 indicates the detection of a hazard condition such as a gas leak, fire, smoke, low air quality, etc., the controller 402, in response to the detection, may repeatedly switch on/off the relay 410 to turn on/off the switched AC power from the relay 410. The driver 306, which receives the switched AC power, may correspondingly turn on/off the DC power that the driver 306 provides to the light source 108 based on the switched AC power. The repeated turning on/off the DC power causes the flashing of the light emitted by the light source 108, which can serve as a visual notification of the detection of the hazard condition by the sensor 104. When the indicator signal from the sensor 104 stops indicating to the controller 402 the detection of the hazard condition, the controller 402 may return the relay 410 to the pre-hazard detection state or another default state, or otherwise return the relay 410 to a normal operating state. Visual notification may be provided using the light emitted by the light source 108 in a similar manner for other conditions that require notification in response to detection by the sensor 104.

In some alternative embodiments, in response to the sensor 104 indicating the detection of the hazard condition to the controller 402, the controller 402 may control the 0-10 v circuit 408 to change the dim level of the light emitted by the light source 108. For example, the controller 402 may repeatedly change the output control signal that the controller 402 provides to the 0-10 v circuit 408, and, in response, the 0-10 v circuit 408 may repeatedly change the dim control signal at the 0-10 v output port 414 to corresponding to different dim levels (e.g., between 10% and 90% dim levels). The driver 306, which may be coupled to the 0-10 v output port 414, may correspondingly change the power provided to the light source 108 to repeatedly change the dim levels of the light emitted by the light source 108. When the indicator signal from the sensor 104 stops indicating to the controller 402 the detection of the hazard condition, the controller 402 may control the 0-10 v circuit 408 to change the dim level of the emitted light to a pre-hazard detection state or to another default state, or otherwise return the 0-10 v circuit 408 to a normal operating state. Visual notification may be provided using the light emitted by the light source 108 in a similar manner for other conditions that require notification in response to detection by the sensor 104.

In some example embodiments, the controller 402 may turn on the siren 314 to provide an audio notification of the detection of a hazard condition (e.g., fire, low air quality, etc.) and/or other similar conditions monitored and/or detected by the sensor 104. The controller 402 may turn off the siren 314 when the sensor signal(s) from the sensor 104 stops indicating the detection of the particular hazard or other condition to the controller 402.

In some alternative embodiments, the driver 306 may include a transceiver that is used for wireless communication instead of or in addition to the transceiver 404. For example, a transceiver in the driver 306 may operate in a similar manner as described above to receive and transmit lighting-related information and/or sensor-related information.

In some example embodiments, the sensor 104 may provide to the controller 402 one or more information signals that provide information such as temperature, airborne particles, etc. instead of or in addition to providing sensor signal(s) that indicates a hazard condition such as a gas leak, fire, smoke, low air quality, etc. to the controller 402. The controller 402 may process the information signal(s) and determine whether to provide a notification of a hazard condition, for example, based on threshold levels stored in a memory device of the control device 310. Upon determining that a notification should be issued, the controller 402 may cause the light source 108 to flash its light or to otherwise provide other visual notification, turn on the siren 314, and/or wirelessly transmit a notification via the transceiver 404. Upon determining that the condition that resulted in the notification is no longer present, for example, based on the information signal(s) from the sensor 104, the controller 402 may return the control device 310 to a pre-hazard notification state or to an otherwise normal operating state. For example, the controller 402 may stop the light source 108 and the siren 314 from providing visual and audio notification. The controller 402 may also wirelessly transmit information to a remote monitoring/control device to indicate that the hazard condition no longer exists.

Although particular components and connections are shown in FIGS. 4A and 4B, in alternative embodiments, the control device 310 may include other components and connection instead of or in addition to those shown. In some alternative embodiments, some of the components shown in FIGS. 4A and 4B may be integrated into a single component without departing from the scope of this disclosure. In some alternative embodiments, some of the components shown in FIGS. 4A and 4B may be omitted without departing from the scope of this disclosure. For example, the relay 410 may be omitted and AC power may be provided to the driver 306 without being controlled by the relay 410. In some alternative embodiments, DC power instead of AC power may be provided to the power supply 406 that generates via the connection 118.

Figure 5:
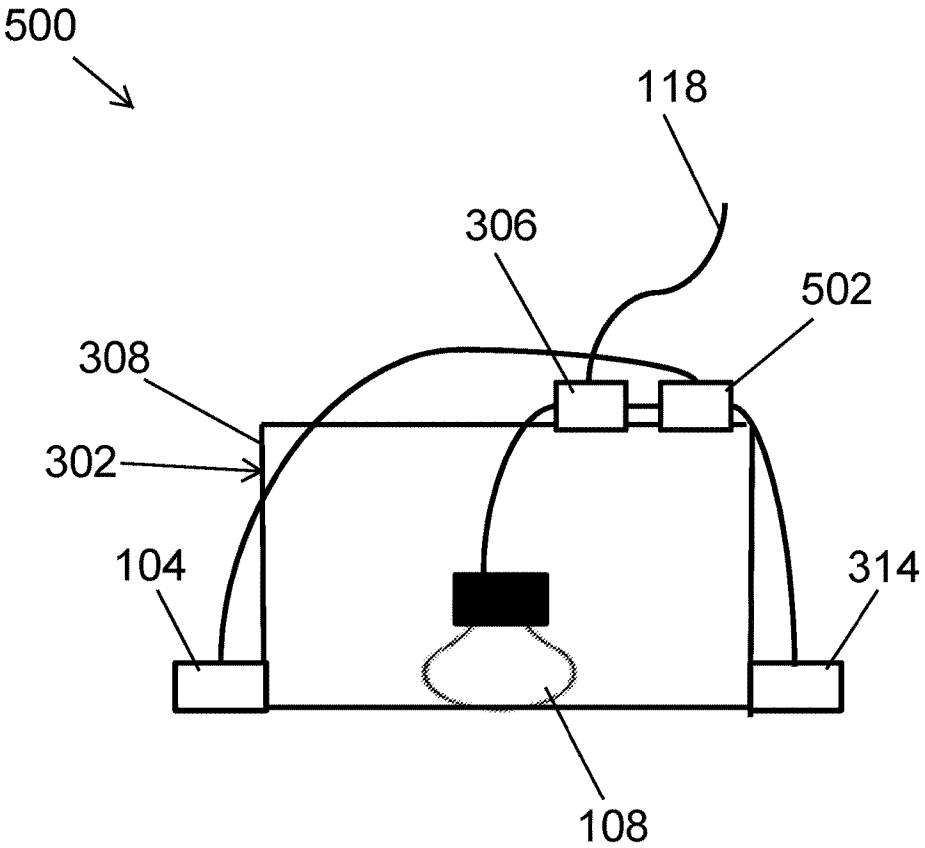
FIG. 5 illustrates a sensing and lighting device according to another example embodiment.

FIG. 5 illustrates a sensing and lighting device 500 according to another example embodiment. The lighting device 500 is substantially the same as the sensing and lighting device 300 of FIG. 3. For example, the lighting device 500 may include the lighting fixture 302 that includes the light source 108 and the driver 306 that is electrically coupled to the light source 108 to provide DC power to the light source 108. In contrast to the sensing and lighting device 300 where the driver 306 is shown as receiving AC power from the control device 310, the driver 306 in the sensing and lighting device 500 may receive AC power from a mains power supply provided via the connection 118 and may generate and provide DC power to the light source 108 from the AC power. In some alternative embodiments, DC power instead of AC power may be provided to the driver 306 via the connection 118. In some alternative embodiments, the driver 306 may be integrated with the light source 108, or may otherwise be located inside the housing 308.

In some example embodiments, the sensing and lighting device 500 includes a control device 502, the sensor 104, and the siren 314. The control device 502 is connected to the sensor 104 and the siren 314 in the same manner as described with respect the control device 310 of FIG. 3. The control device 502 also controls the driver 306 in a similar manner as described with respect to FIG. 3, for example, to change the dim level of the light emitted by the light source 108.

In some example embodiments, in contrast to the control device 310 of FIG. 3, the control device 502 may include or may be coupled to a battery power source. For example, the control device 502 may provide DC power to the sensor 104 and the siren 314 directly from a battery or by generating DC power, for example, using one or more DC/DC converter that convert DC power from the battery to power levels compatible with the sensor 104 and the siren 314 as well as other components.

In some example embodiments, the sensing and lighting device 500 performs air quality monitoring, hazard detection, and notification in the same manner as described above with respect to the sensing and lighting device 300.

Figure 6:
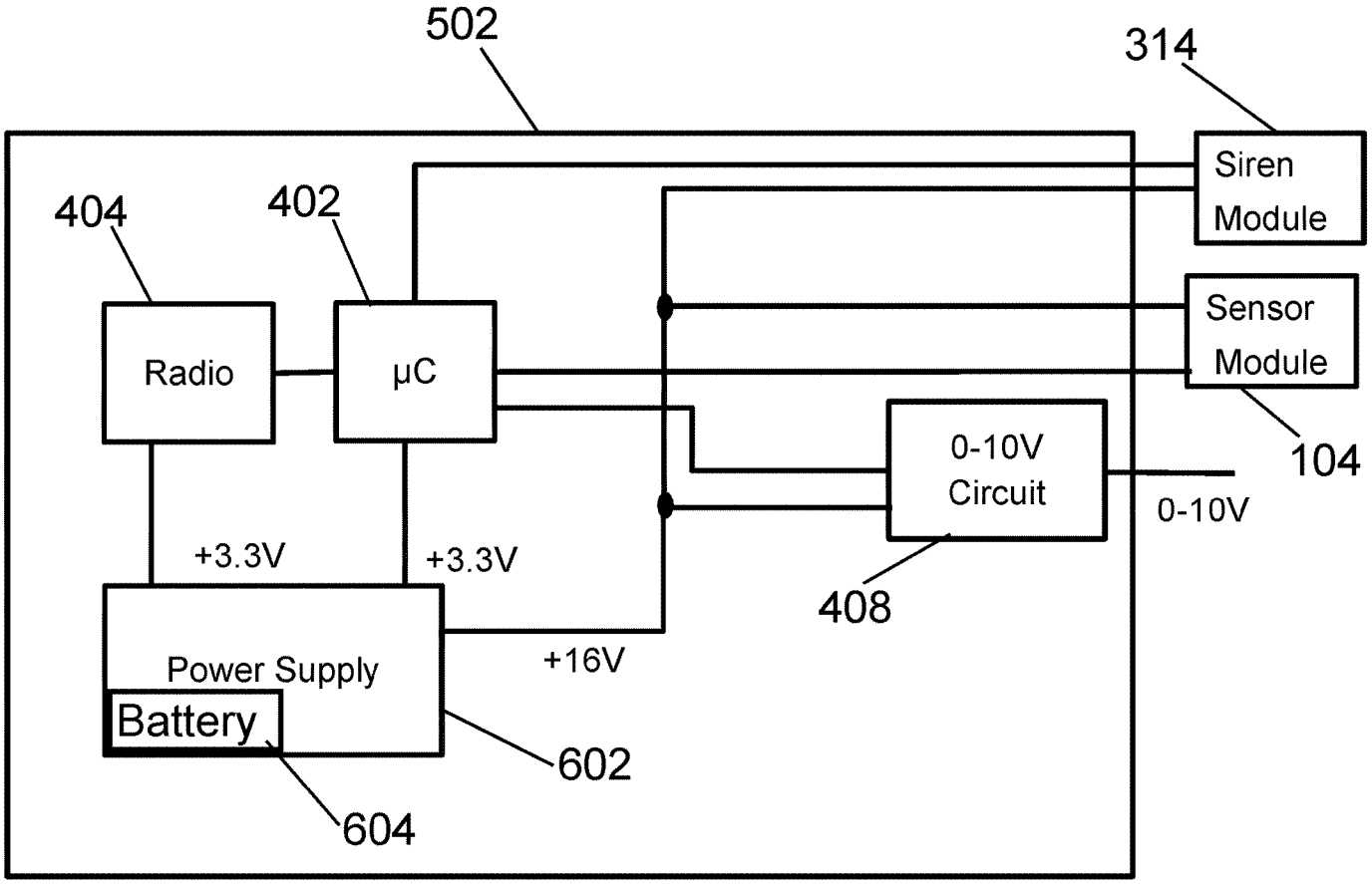
FIG. 6 illustrates the control device of the sensing and lighting device of FIG. 5 according to an example embodiment.

FIG. 6 illustrates the control device 502 of the sensing and lighting device 500 of FIG. 5 according to an example embodiment. Referring to FIGS. 3-6, the control device 502 includes the controller 402, the wireless transceiver 404, the 0-10 v dim control circuit 408, and a power supply 602. The controller 402 is in electrical communication with the transceiver 404 and the 0-10 v circuit 408 and operates in a same manner as described above. The controller 402 is also in electrical communication with the sensor 104 and the siren 314 in the same manner as described above.

In contrast to the power supply 406 of the control device 310, the power supply 602 includes a battery 604 as a power source instead of the mains supply. To illustrate, the power supply 406 may generate from the battery 604 DC power that is provided to the controller 402, the transceiver 404, the 0-10 v circuit 408, the sensor 104, and the siren 314. For example, the power supply 402 may include one or more DC/DC converters to generate the appropriate DC levels. As a non-limiting example, the battery 604 may be a 9-Volt battery that is used to generate approximately 3.3V and 16V using DC/DC converters in a manner known to those of ordinary skill in the art with the benefit of this disclosure. In some alternative embodiments, DC power may be provided to one or more components of the sensing and lighting device 500 from the battery 604 instead of from a DC/DC converter.

In some example embodiments, in response to one or more signals from the sensor 104, the controller 402 may control the 0-10 v circuit 408 to flash the light emitted by the light source 108, to change the intensity level of the light, etc. in the same manner as described above.

Although the battery 604 is shown inside the power supply 602, in alternative embodiments, the battery 604 may be outside of the power supply 602 or outside of the control device 502. Although particular components and connections are shown in FIG. 6, in alternative embodiments, the control device 502 may include other components and connection instead of or in addition to those shown. In some alternative embodiments, some of the components shown in FIG. 6 may be integrated into a single component without departing from the scope of this disclosure. In some alternative embodiments, some of the components shown in FIG. 6 may be omitted without departing from the scope of this disclosure.

Figure 7:
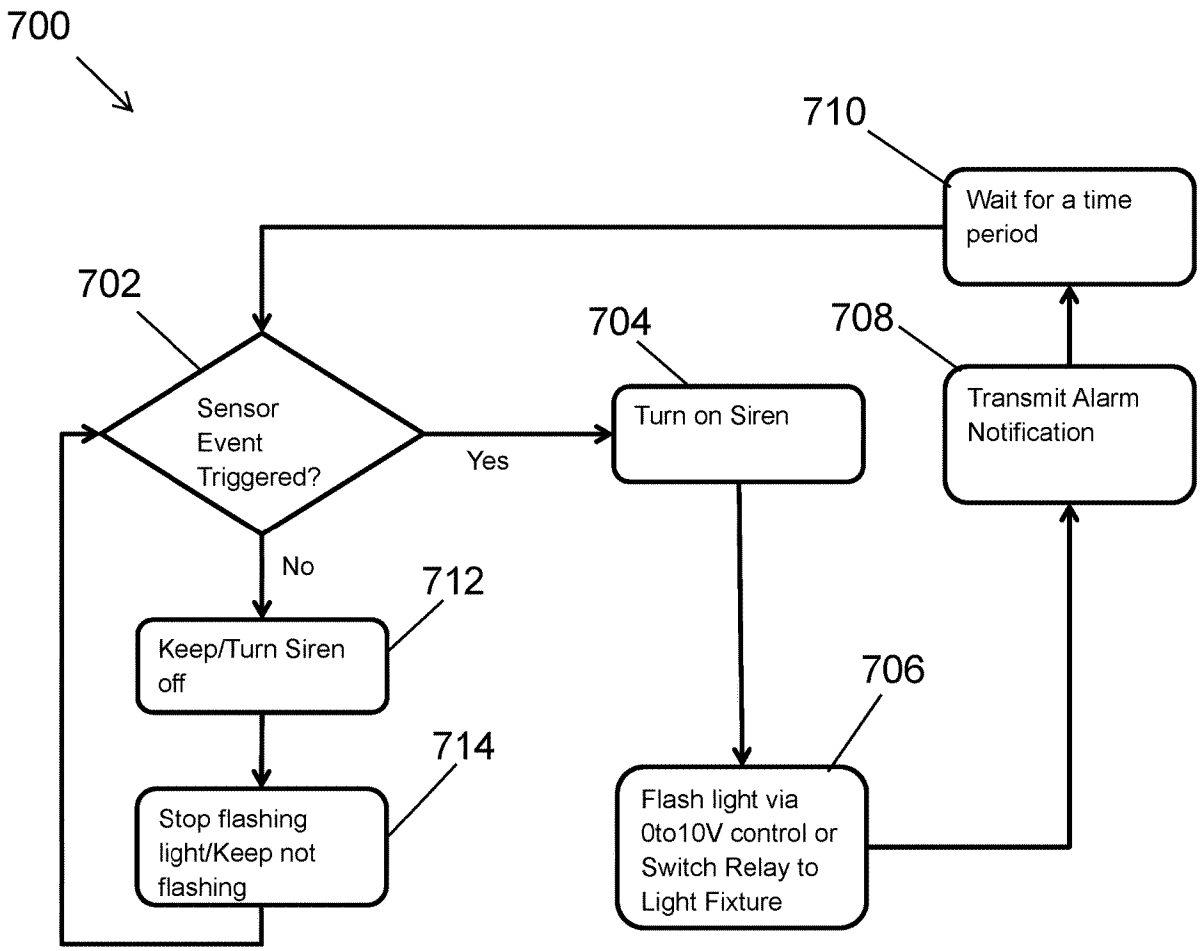
FIG. 7 illustrates a method of air quality monitoring, hazard detection, and notification using the sensing and lighting devices of FIGS. 1, 2, 3, and 5 according to an example embodiment.

FIG. 7 illustrates a method 700 of air quality monitoring, hazard detection, and notification using the sensing and lighting devices of FIGS. 1, 2, 3, and 5 according to an example embodiment. Referring to FIGS. 1-7, the method 700 includes determining whether a sensor event is triggered, at step 702. For example, the sensor 104 may provide to the controller 402 a signal indicating the detection of smoke, fire, carbon monoxide, natural gas leak, earth quake or another hazardous condition such as low air quality. Alternatively, the controller 402 may determine whether a hazard condition exists by comparing sensor data from the sensor 104 against a threshold level. If the hazard condition and/or a condition that otherwise requires providing a notification exist, the method 700 may include, at step 704, turning on the siren 314. At step 706, the method 700 includes flashing the light emitted by the light source 108 using the 0-10 v circuit 408 or the relay 410 as described above. Alternatively, the controller 402 may control a dimming circuit other than the 0-10 v circuit 408 to flash the light emitted by the light source 108.

In some example embodiments, the method 700 includes at step 708 transmitting a notification of the hazard condition. For example, the controller 402 may use the transceiver 404 to wirelessly transmit information indicating the hazard condition (e.g., fire, low air quality, etc.), for example, to a control/monitoring station. The transceiver 404 may transmit wireless signals compatible with one or more wireless standards Wi-Fi, ZigBee, Bluetooth, etc. At step 710, the method 700 may include waiting for a period of time (e.g., 10 seconds, 30 seconds, 1 minute, etc.) before returning to step 702 to keep monitoring whether a sensor event is triggered. For example, by waiting for a period of time at step 710, the flashing of the light emitted by the light source 108 is likely to have occurred enough times to be noticed by occupants of a room.

In some example embodiments, if a hazard condition or another condition that may require notification is not detected at step 702, the method 700 includes, at steps 712, 714, keeping or turning the siren 314, if present, off, and stopping, if already flashing, the light emitted by the light source 108 from flashing. From step 714, the method 700 continues with checking whether a sensor event is triggered at step 702.

Although a particular order of the steps of the method 700 are shown in FIG. 7, in some alternative embodiments, some of the steps may be performed in a different order than shown or may be omitted or skipped without departing from the scope of this disclosure. Although particular steps and orders of the steps of the method 700 are shown in FIG. 7, in alternative embodiments, the method 700 may include other steps before, between, or after the steps described above.

Figure 8:
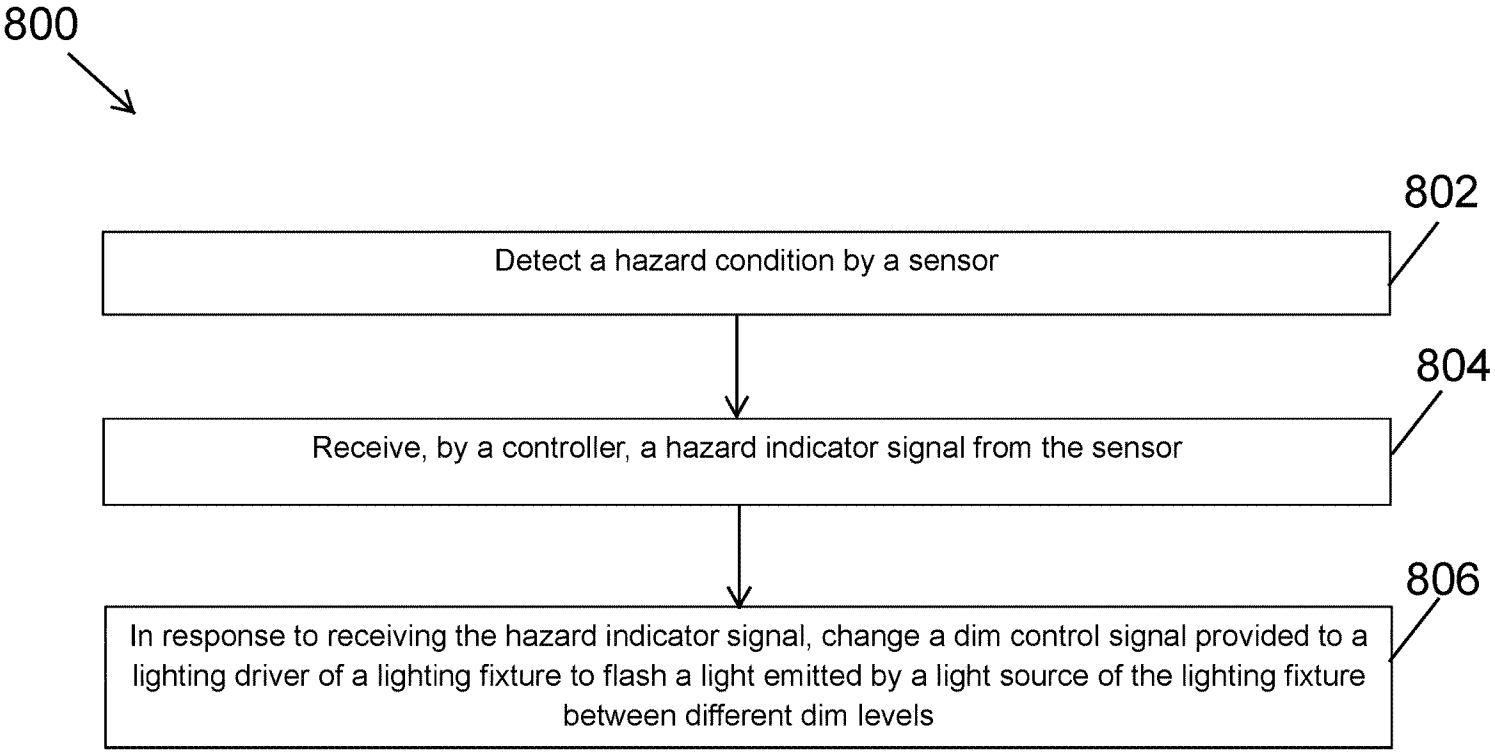
FIG. 8 illustrates a method of hazard detection and notification using the hazard detection and notification lighting device of FIGS. 1, 3, and 5 according to another example embodiment.

FIG. 8 illustrates a method 800 of hazard detection and notification using the hazard detection and notification lighting device of FIGS. 1, 3, and 5 according to another example embodiment. Referring to FIGS. 1-6 and 8, in some embodiments, the method 800 includes detecting a hazard condition by a sensor at step 802. For example, the sensor 104 may detect a hazard condition such as fire, smoke, low air quality, etc. At step 804, the method 800 may include receiving, by a controller, a hazard indicator signal from the sensor. For example, the controller 402 may receive a sensor signal from the sensor 104, where the sensor signal indicates the detection of a hazard condition by the sensor 104 or the signal may carry information that may be used to determine whether a hazard condition exists.

At step 806, the method 800 may include, in response to receiving the hazard indicator signal, changing a dim control signal provided to a driver of a lighting fixture to flash a light emitted by a light source of the lighting fixture between different dim levels. For example, the controller 404 may control the 0-10 v circuit so that the 0-10 v circuit changes a dim control signal provided to the driver 306 repeatedly such that the light emitted by the light source 108 flashes.

Although particular steps and orders of the steps of the method 800 are shown in FIG. 8, in alternative embodiments, the method 800 may include other steps before, between, or after the steps described above.

Figure 9:
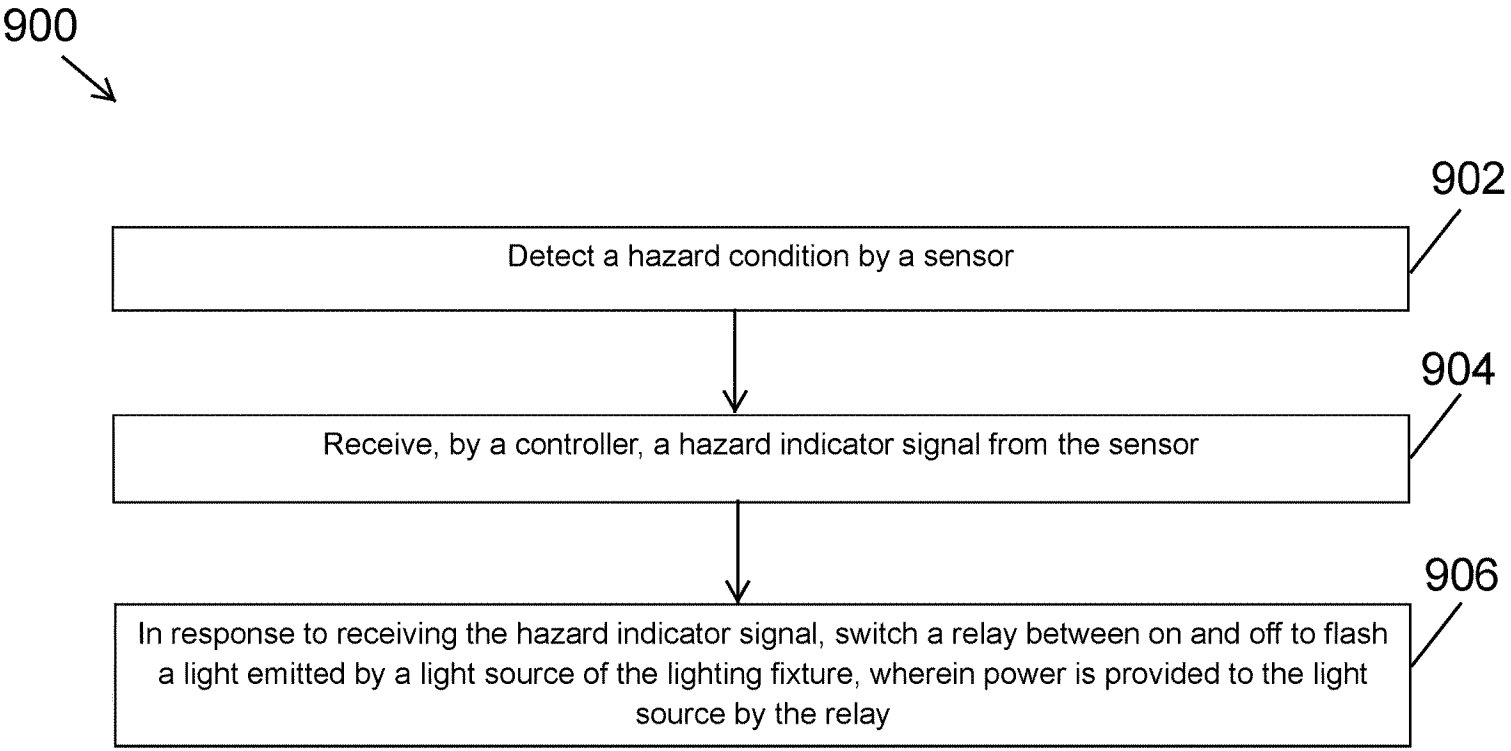
FIG. 9 illustrates a method of hazard detection and notification using the hazard detection and notification lighting device of FIGS. 1, 3, and 5 according to another example embodiment.

FIG. 9 illustrates a method 900 of hazard detection and notification using the hazard detection and notification lighting device of FIGS. 1, 3, and 5 according to another example embodiment. Referring to FIGS. 1-6 and 9, in some embodiments, the method 900 includes at step 902 detecting a hazard condition by a sensor. For example, the sensor 104 may detect a hazard condition such as fire, smoke, low air quality, etc. At step 904, the method 900 includes receiving, by a controller, a hazard indicator signal from the sensor. For example, the controller 402 may receive a sensor signal from the sensor 104, where the sensor signal indicates the detection of a hazard condition by the sensor 104 or the signal may carry information that may be used to determine whether a hazard condition exists.

At step 906, the method 900 includes, in response to receiving the hazard indicator signal, switch a relay between on and off to flash a light emitted by a light source of the lighting fixture, wherein power is provided to the light source by the relay. For example, the controller 404 may control the relay 410 to cause the light emitted by the light source to flash.

Although particular steps and orders of the steps of the method 900 are shown in FIG. 9, in alternative embodiments, the method 900 may include other steps before, between, or after the steps described above.

Figure 10:
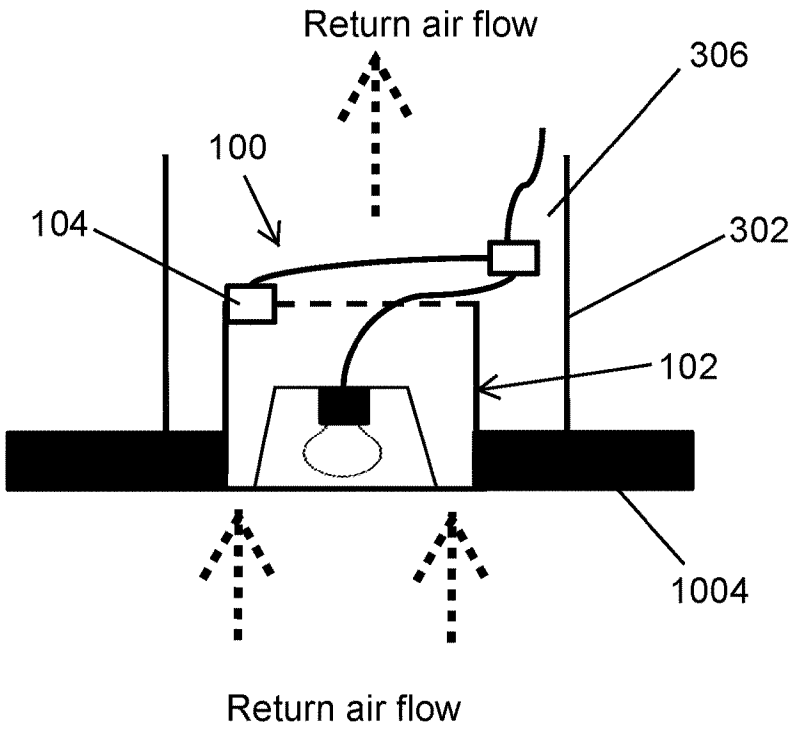
FIG. 10 illustrates the sensing and lighting device of FIG. 1 installed in a ceiling according to an example embodiment.

FIG. 10 illustrates the sensing and lighting device 100 of FIG. 1 installed in a ceiling 1004 according to an example embodiment. Referring to FIGS. 1 and 10, in some example embodiments, the sensing and lighting device 100 is positioned in an air duct 1002 that is behind the ceiling 1004. For example, the air duct 1002 may be an HVAC air duct, and the sensing and lighting device 100 may be positioned in an inside space 1006 of the air duct 1002 proximal to an opening of the air duct 1002. To illustrate, the air duct 1002 may be an HVAC return air duct where air flows into the air duct 1002 from the area below the ceiling 1004 that is air conditioned by the air conditioning system. For example, the area below the ceiling 1004 may be an area that is occupied by people or that is connected to such an area. As air flows through the sensing and lighting device 100 and past the sensor 104, the sensor 104 may monitor the quality of the air as described above with respect to FIG. 1. In some example embodiments, the air duct 1002 may be a supply air duct (e.g., an HVAC supply air duct).

Although FIG. 10 illustrates the sensing and lighting device 100 of FIG. 1 installed in a ceiling, in some alternative embodiments, the sensing and lighting devices 300, 500 may instead be installed in the ceiling, where the sensor 104 is positioned in the inside of the housing of the lighting fixture. In some alternative embodiments, the sensor 104 may be in the path of the return air at a location other than shown in FIG. 10 without departing from the scope of this disclosure.

Figure 11:
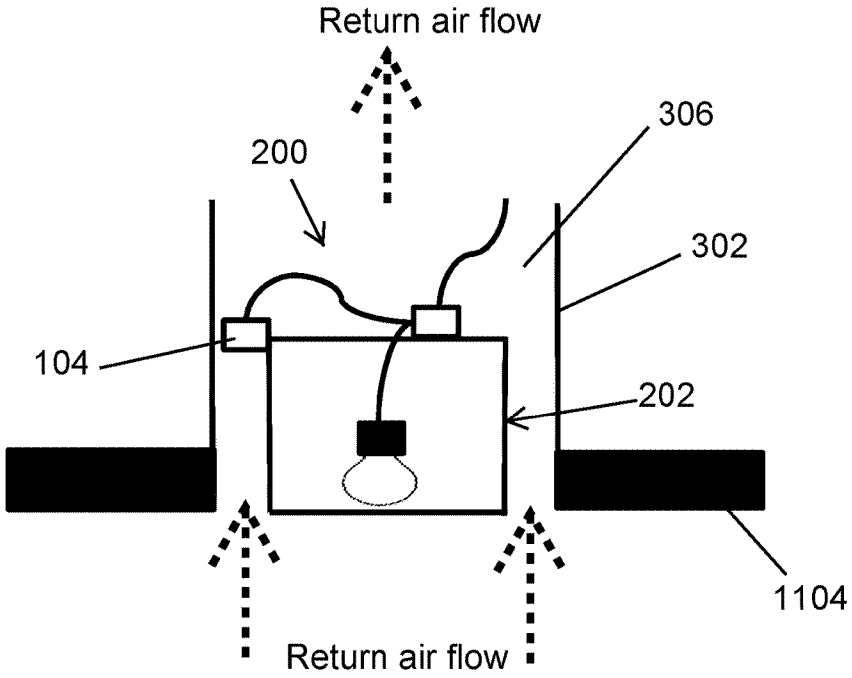
FIG. 11 illustrates the sensing and lighting device of FIG. 2 installed in a ceiling according to an example embodiment.

FIG. 11 illustrates the sensing and lighting device 200 of FIG. 2 installed in a ceiling 1104 according to an example embodiment. Referring to FIGS. 2 and 11, the sensing and lighting device 200 is positioned in the air duct 1102 behind a ceiling 1104. For example, the air duct 302 may be an HVAC return air duct where air flows into the air duct 1102 from the area below the ceiling 1104. For example, the area below the ceiling 1104 may be an area that is occupied by people or that is connected to such an area. The sensing and lighting device 200 may be positioned in an inside space 1106 of the air duct 1102 proximal to an opening of the air duct 1102. As air flows past the sensor 104 of the lighting device 200 on the outside of the lighting fixture 202, the sensor 104 may monitor the quality of the air as described above with respect to FIG. 2. In some example embodiments, the air duct 1102 may be a supply air duct (e.g., an HVAC supply air duct).

Although FIG. 11 illustrates the sensing and lighting device 200 of FIG. 2 installed in a ceiling, in alternative embodiments, the sensing and lighting devices 100, 300, 500 may instead be installed in the ceiling in a similar manner. In some alternative embodiments, the sensor 104 may be in the path of the return air at a location other than shown in FIG. 11 without departing from the scope of this disclosure.

Figure 12:
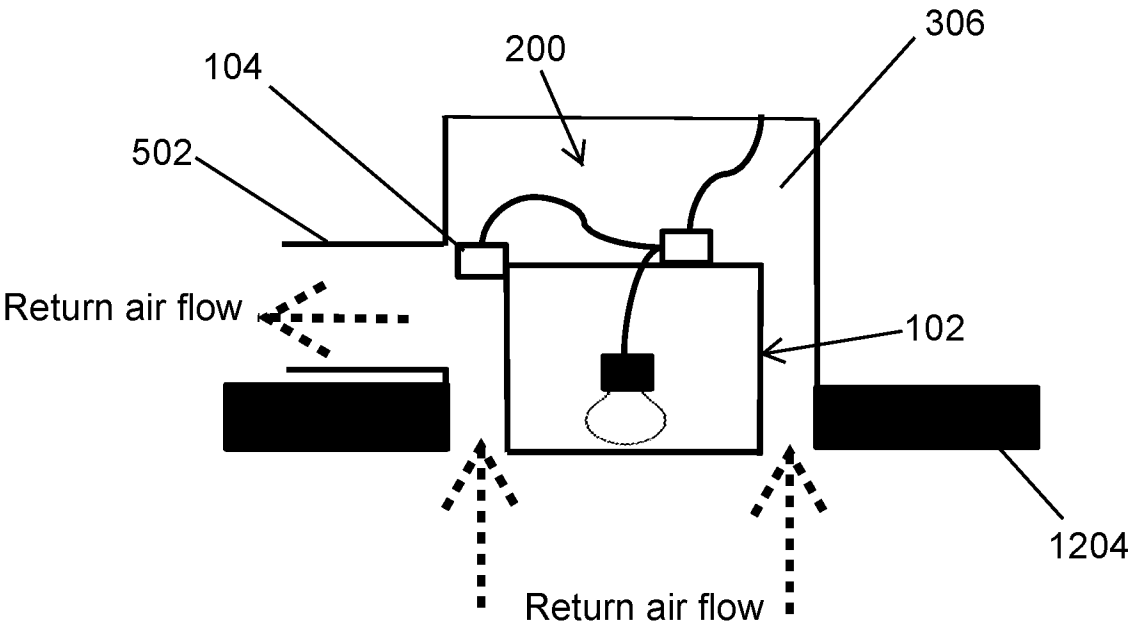
FIG. 12 illustrates the sensing and lighting device of FIG. 2 installed in a ceiling according to another example embodiment.

FIG. 12 illustrates the sensing and lighting device 200 of FIG. 2 installed in a ceiling 1204 according to another example embodiment. Referring to FIGS. 2 and 12, in contrast to FIG. 11, the sensing and lighting device 200 in FIG. 12 is positioned in a side air duct 1202. The area below the ceiling 1104 may be an area that is occupied by people or that is connected to such an area. The sensing and lighting device 200 may be positioned in an inside space 1206 of the air duct 1202 proximal to an opening of the air duct 1102. As air flows past the sensor 104 of the lighting device 200 on the outside of the lighting fixture 202, the sensor 104 may monitor the quality of the air as described above with respect to FIG. 2. In some example embodiments, the air duct 1102 may be a supply air duct (e.g., an HVAC supply air duct).

Although FIG. 12 illustrates the sensing and lighting device 200 of FIG. 2 installed in a ceiling, in some alternative embodiments, the sensing and lighting devices 100, 300, 500 may instead be installed in the ceiling in a similar manner. In some alternative embodiments, the sensor 104 may be in the path of the return air at a location other than shown in FIG. 12 without departing from the scope of this disclosure.

Figure 13:
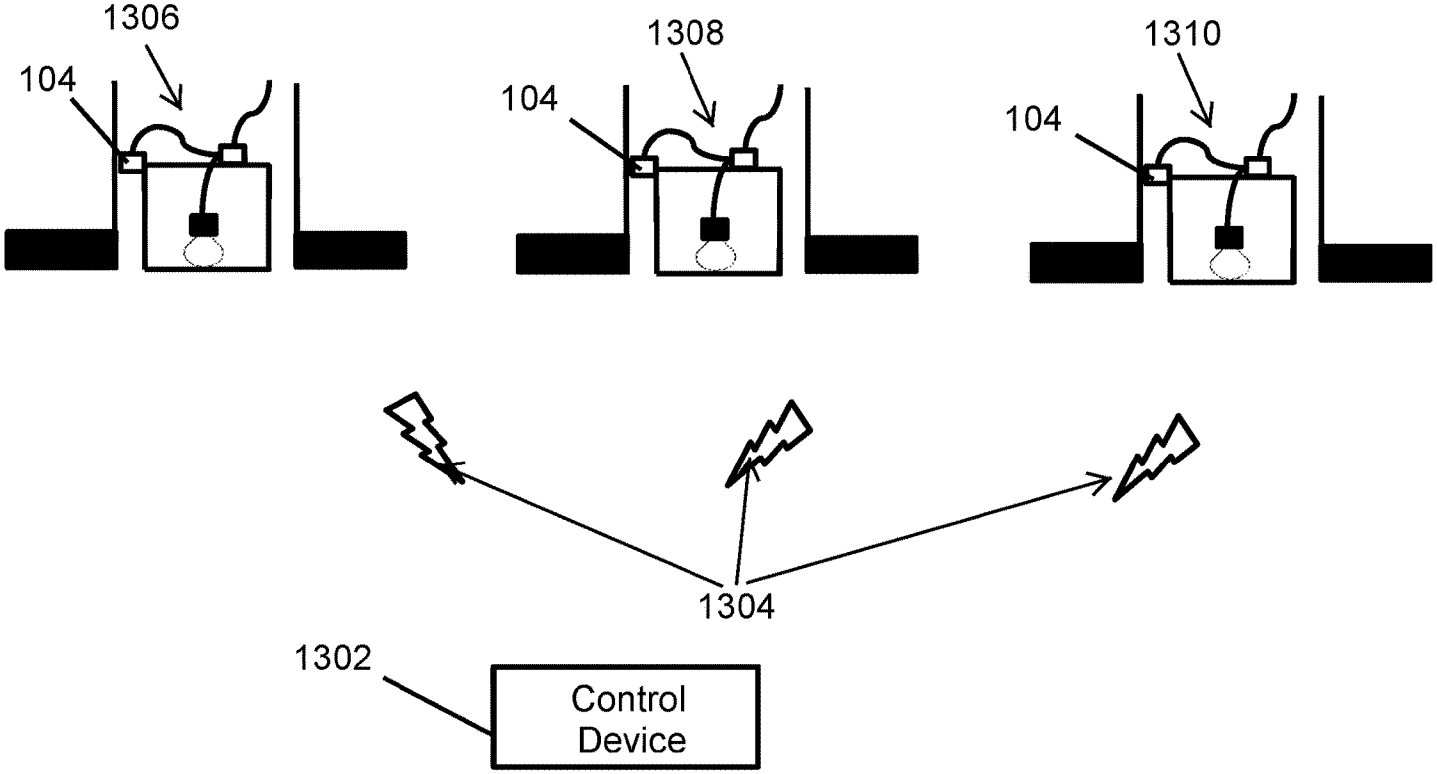
FIG. 13 illustrates a network of the sensing and lighting devices according to an example embodiment.

FIG. 13 illustrates a network 1300 of the sensing and lighting devices 1306, 1308, 1310 according to an example embodiment. For example, each one of the sensing and lighting devices 1306, 1308, 1310 may correspond to the sensing and lighting device 200 of FIG. 2. Alternatively, the sensing and lighting devices of FIGS. 1, 3, and 5 may be included the network 1300 instead of or in addition to the sensing and lighting device 200.

In some example embodiments, the network 1300 includes a wireless control device 1302. For example, the wireless control device 1302 may be a mobile phone, a laptop, a table, or a wall mounted control device with a display, etc. The sensing and lighting devices 1306, 1308, 1310 may wirelessly communicate with the wireless control device 1302 via wireless signals 1304. For example, the control device 1302 may wirelessly control the lighting-related operations of the sensing and lighting devices 1306, 1308, 1310. In some example embodiments, the sensing and lighting devices 1306, 1308, 1310 may communicate air quality information, hazard condition information, etc. wirelessly to the wireless control device 1302, and may receive information and commands wirelessly from the wireless control device 1302. For example, the sensing and lighting devices 1306, 1308, 1310 may wirelessly receive instructions to stop providing visual and/or audio notification. In general, the wireless control device 1302 may communicate wirelessly with the sensing and lighting devices 1306, 1308, 1310 in the same manner as described above.

In some example embodiments, one or more of the sensing and lighting devices 1306, 1308, 1310 may flash their respective lights to provide notification of a hazard condition that, for example, is detected by the respective sensor 104 of the one or more of the sensing and lighting devices 1306, 1308, 1310. In some example embodiments, fewer than all the sensing and lighting devices 1306, 1308, 1310 may flash their respective lights to provide notification as well as a guide to an exit, to a particular sensing and lighting device that detected the hazard, etc.

In some example embodiments, the sensor 104 of each sensing and lighting devices 1306, 1308, 1310 may wirelessly communicate with the wireless control device 1302 or with each other using the transceivers of the sensing and lighting devices 1306, 1308, 1310. Alternatively, the sensor 104 of each sensing and lighting devices 1306, 1308, 1310 may wirelessly communicate with the wireless control device 1302 or with each other on a separate network without using the transceivers of the sensing and lighting devices 1306, 1308, 1310. In some alternative embodiments, the sensing and lighting devices 1306, 1308, 1310 may use a wired network (e.g., an Ethernet network) to communicate with the control device 1302 or with another remote control device. For example, the sensor of each sensing and lighting devices 1306, 1308, 1310 may be communicate with the control device 1302 over a wired network instead of a wireless network.

Although three sensing and lighting devices are shown in FIG. 13, in alternative embodiments, the network 1300 may include fewer or more than three sensing and lighting devices. In some example embodiments, the network 1300 may include other network components such as routers without departing from the scope of this disclosure. In some example embodiments, the network 1300 may operate in compliance with one or more wireless communications standards such as Wi-Fi, ZigBee, etc.

Although FIG. 13 illustrates the sensing and lighting devices 200 of FIG. 2 installed in a ceiling, in some alternative embodiments, the network 1300 may include one or more of the sensing and lighting devices 100, 300, 500 installed in the ceiling in a similar manner instead of or in addition to one or more of the sensing and lighting devices 200.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A sensing and lighting device, comprising:

a lighting fixture comprising a housing and a light emitting diode (LED) light source that is at least partially in the housing and configured to emit an illumination light;

a sensor to sense air at the sensor; and a power source that is external to the housing, wherein the LED light source and the sensor are powered by the power source, wherein the sensing and lighting device is sized to fit in a return air plenum of an air conditioning system at a location proximal to an opening of the return air plenum at a ceiling above an area to be air conditioned by the air conditioning system, and wherein the LED light source is configured to flash the illumination light to indicate a detection of a hazard condition based on a sensing of the air by the sensor.

2. The sensing and lighting device of claim 1, wherein the sensor is positioned outside of the housing of the lighting fixture such that at least a portion of the air that flows in the return air plenum passes by the sensor from an area that is air conditioned by the air conditioning system.

3. The sensing and lighting device of claim 1, wherein the sensor is positioned inside the housing of the lighting fixture such that at least a portion of the air that flows in the return air plenum passes by the sensor from an area that is air conditioned by the air conditioning system.

4. The sensing and lighting device of claim 1, further comprising a wireless transmitter, wherein the wireless transmitter wirelessly transmits air quality information provided by the sensor.

5. The sensing and lighting device of claim 4, wherein the air quality information indicates whether one or more air pollutants are detected.

6. The sensing and lighting device of claim 1, wherein the sensor detects the hazard condition and wherein the hazard condition includes one or more of fire, smoke, carbon monoxide, and natural gas.

7. The sensing and lighting device of claim 6, further comprising a wireless transmitter, wherein the wireless transmitter wirelessly transmits information indicating the detection of the hazard condition by the sensor.

8. The sensing and lighting device of claim 6, further comprising a siren, wherein the siren emits a sound in response to the detection of the hazard condition.

9. A sensing and lighting device, comprising:

a lighting fixture comprising a housing and a light emitting diode (LED) light source that is at least partially in the housing and configured to emit an illumination light;

a sensor to sense air at the sensor, wherein the sensing and lighting device is sized to fit in a return air plenum of an air conditioning system at a location proximal to an opening of the return air plenum at a ceiling above an area to be air conditioned by the air conditioning system;

a driver that provides power to the LED light source; and a control device configured to control the driver to control the power provided by the driver to the LED light source based on whether a hazard condition is detected by the sensor.

10. The sensing and lighting device of claim 9, wherein the control device comprises a 0-10 v circuit that provides a 0-10 v dim control signal to the driver and wherein the 0-10 v circuit changes the 0-10 v dim control signal to flash a light emitted by the LED light source in response to a detection of the hazard condition by the sensor.

11. The sensing and lighting device of claim 9, wherein the control device comprises a relay that receives an AC power signal and outputs a switched AC power that is provided to the driver and wherein the control device switches the switched AC power on and off to flash a light emitted by the LED light source in response to a detection of the hazard condition by the sensor.

12. The sensing and lighting device of claim 9, further comprising a wireless transmitter, wherein the wireless transmitter wirelessly transmits information indicating a detection of the hazard condition by the sensor.

13. The sensing and lighting device of claim 12, wherein the hazard condition includes one or more of fire, smoke, carbon monoxide, and natural gas.

14. The sensing and lighting device of claim 9, further comprising a siren, wherein the siren emits a sound in response to a detection of the hazard condition.

15. A system of sensing and lighting devices, the system comprising:

a first sensing and lighting device;

a second sensing and lighting device; and a wireless control device that wirelessly receives air quality information from the first sensing and lighting device and from the second sensing and lighting device, wherein the first sensing and lighting device and the second sensing and lighting device are each positioned in a respective return air plenum of an air conditioning system proximal to an opening of the respective return air plenum at a ceiling above an area that is air conditioned by the air conditioning system, wherein the first sensing and lighting device and the second sensing and lighting device each comprise:

a lighting fixture comprising a housing and a light emitting diode (LED) light source that is at least partially in the housing and configured to emit an illumination light;

a sensor to sense air at the sensor; and a power source that is external to the housing, wherein the LED light source and the sensor are powered by the power source and wherein the LED light source is configured to flash the illumination light to indicate a detection of a hazard condition based on a sensing of the air by the sensor.

16. The system of claim 15, wherein the air quality information indicates whether one or more air pollutants are detected.

17. The system of claim 15, wherein the air quality information indicates whether a hazard condition is detected and wherein the hazard condition includes one or more of fire, smoke, carbon monoxide, and natural gas.

* * * * *